US008975218B2

(12) United States Patent
Ikuma et al.

(10) Patent No.: US 8,975,218 B2
(45) Date of Patent: Mar. 10, 2015

(54) GREASE COMPOSITION COMPRISING POLYMER ALLOY, A STRUCTURE PART ENCLOSING THE SAME AND A METHOD FOR PRODUCING THE GREASE COMPOSITION

(75) Inventors: Kyosuke Ikuma, Fujisawa (JP); Yosuke Takao, Fujisawa (JP); Takashi Takizawa, Fujisawa (JP); Iwaki Hirooka, Fujisawa (JP); Yosuke Endo, Fujisawa (JP); Akihiko Urashima, Fujisawa (JP)

(73) Assignee: Kyodo Yushi Co., Ltd., Fujisawa-Shi, Kanagawa (JP)

( * ) Notice: Subject to any disclaimer, the term of this patent is extended or adjusted under 35 U.S.C. 154(b) by 0 days.

(21) Appl. No.: 13/365,531

(22) Filed: Feb. 3, 2012

(65) Prior Publication Data

US 2012/0214721 A1 Aug. 23, 2012

(30) Foreign Application Priority Data

Feb. 4, 2011 (JP) ..... 2011-022689
Jan. 31, 2012 (JP) ..... 2012-018707

(51) Int. Cl.

| | |
|---|---|
| ***C10M 113/08*** | (2006.01) |
| ***C10M 157/00*** | (2006.01) |
| ***C10M 143/10*** | (2006.01) |
| ***C10M 169/06*** | (2006.01) |

(52) U.S. Cl.

CPC ..... *C10M 169/06* (2013.01); *C10M 2203/1025* (2013.01); *C10M 2205/022* (2013.01); *C10M 2205/024* (2013.01); *C10M 2205/0285* (2013.01); *C10M 2205/04* (2013.01); *C10M 2205/06* (2013.01); *C10M 2207/0406* (2013.01); *C10M 2207/1285* (2013.01); *C10M 2207/2805* (2013.01); *C10N 2220/021* (2013.01); *C10N 2230/70* (2013.01); *C10N 2250/10* (2013.01)

USPC ..... 508/591; 508/519

(58) Field of Classification Search

CPC ..... C10M 2205/066; C10M 2205/006; C10M 2207/1256

USPC ..... 508/591

See application file for complete search history.

(56) References Cited

U.S. PATENT DOCUMENTS 6,300,288 B1 * 10/2001 Scharf et al. ..... 508/221
2009/0062165 A1 * 3/2009 Denis et al. ..... 508/172

FOREIGN PATENT DOCUMENTS

| | | |
|---|---|---|
| JP | 2002-327188 | 11/2002 |
| JP | 2004-339447 | 12/2004 |
| JP | 2007-297422 | 11/2007 |

OTHER PUBLICATIONS

Lubrizol Corp., MSDS Lubrizol 7460, revision date Aug. 22, 2013.*

* cited by examiner

*Primary Examiner* — Vishal Vasisth
(74) *Attorney, Agent, or Firm* — Nixon & Vanderhye P.C.

(57) ABSTRACT

A grease composition having a thickener, a base oil containing a hydrocarbon oil, and a polymer alloy of an olefin copolymer and a styrene-based copolymer is disclosed.

7 Claims, 1 Drawing Sheet

SCHEMATIC DIAGRAM OF OIL SEPARATION BY IP STANDARD

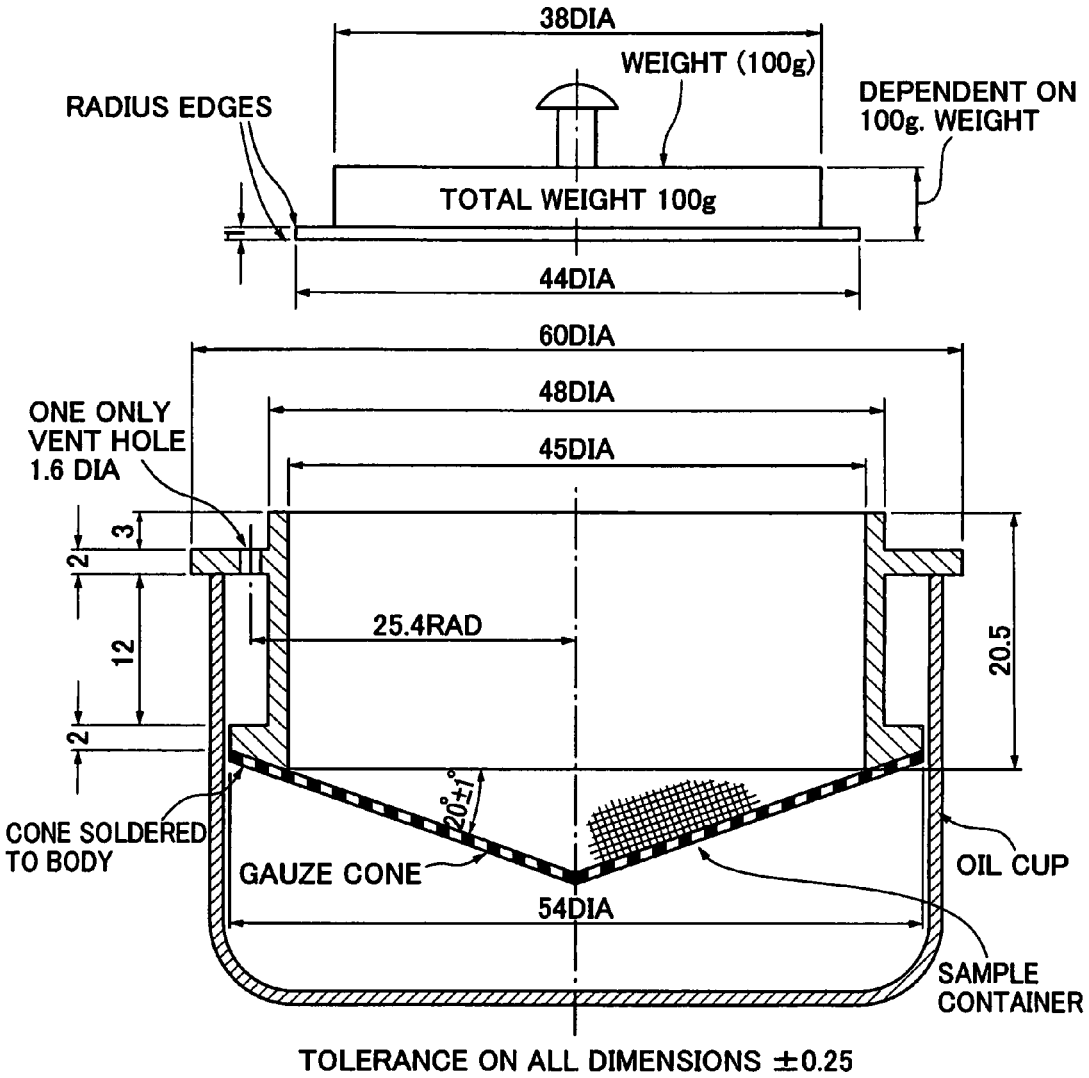
SCHEMATIC DIAGRAM OF OIL
SEPARATION BY IP STANDARD

GREASE COMPOSITION COMPRISING POLYMER ALLOY, A STRUCTURE PART ENCLOSING THE SAME AND A METHOD FOR PRODUCING THE GREASE COMPOSITION

FIELD OF THE INVENTION

The present invention relates to a polymer alloy-containing grease composition which is suitable for use in the structure parts of the automobile components, office automation (OA) equipment, audiovisual (AV) equipment and the like; a structure part enclosing the above-mentioned grease composition; and a method for producing the grease composition.

BACKGROUND OF THE INVENTION

Grease is used for the sliding portions in the structure parts of automobile components, OA/AV equipment and the like. Oil may separate from the grease composition, especially under the conditions of high temperatures. The structure parts may be stained with oil thus separating from the grease, which may cause some problems. In light of this, the grease used for the sliding portions in the structure parts of the automobile components, OA/AV equipment and the like is required to prevent the oil separation. The phenomenon of oil separation has a variety of modes, for example, oozing of oil from the grease, and collection of oil on the surface of grease (the so-called syneresis), which is observed after the grease is stored in a pail or drum for a long period of time.

It has been reported that addition of a styrene-based block copolymer can prevent the oil separation (JP 2002-327188 A, JP 2004-339447 A and JP 2007-297422 A).

SUMMARY OF THE INVENTION

Accordingly, an object of the invention is to provide a grease composition capable of preventing oil separation under the conditions of high temperatures.

Another object of the invention is to provide a structure part enclosing the above-mentioned grease composition.

A further object of the invention is to provide a method for producing the above-mentioned grease composition.

The inventors of the present invention have found that a polymer alloy of an olefin copolymer and a styrene-based block copolymer shows excellent compatibility with poly-α-olefin, and then obtained a grease composition capable of preventing oil separation under the conditions of high temperatures by adding the above-mentioned polymer alloy to a base oil containing a hydrocarbon oil.

The present invention has been accomplished based on the above-mentioned findings.

Accordingly, the present invention provides a grease composition shown below, a structure part enclosing the grease composition, and a method for producing the grease composition:

(1) A grease composition comprising a thickener, a base oil comprising a hydrocarbon oil, and a polymer alloy of an olefin copolymer and a styrene-based copolymer.

(2) The grease composition of the above-mentioned item (1), wherein the olefin copolymer is a ethylene-propylene copolymer or a copolymer of ethylene and α-olefin, and the styrene-based copolymer is a copolymer of styrene and a monomer selected from the group consisting of butene, propene, butadiene and isoprene.

(3) The grease composition of the above-mentioned item (1), wherein the polymer alloy comprises a ethylene-propylene copolymer and a block copolymer of styrene and isoprene.

(4) The grease composition of any one of the above-mentioned items (1) to (3), wherein the polymer alloy has a weight average molecular weight of 10,000 to 450,000.

(5) The grease composition of any one of the above-mentioned items (1) to (4), wherein the polymer alloy is contained in an amount of 0.1 to 10.0 mass % based on the total mass of the composition.

(6) A structure part enclosing the grease composition of any one of the above-mentioned items (1) to (5).

(7) A method for producing the grease composition of any one of the above-mentioned items (1) to (5), comprising the step of kneading a base grease comprising a thickener and a hydrocarbon oil-containing base oil together with a hydrocarbon oil-containing base oil comprising a polymer alloy of an olefin copolymer and a styrene-based copolymer.

The invention makes it possible to provide a grease composition excellent in the effect of preventing oil separation under the conditions of high temperatures. A structure part enclosing the grease composition of the invention can reduce the occurrence of stain with oil and other problems because the oil separation from the grease composition can be minimized. In addition, the invention can constantly and readily produce a grease composition that shows an excellent effect of preventing oil separation.

BRIEF DESCRIPTION OF THE DRAWING

FIG. 1 is a schematic diagram showing a system for determination of oil separation in accordance with the IP standard.

DETAILED DESCRIPTION OF THE INVENTION

Hydrocarbon Oil-Containing Base Oil

A base oil that can be used in the invention contains a hydrocarbon oil. The hydrocarbon oil may be a synthetic oil or a mineral oil. A mixed oil of a synthetic hydrocarbon oil and a mineral oil may be used. The hydrocarbon oil may preferably contain a synthetic hydrocarbon oil. Examples of the synthetic hydrocarbon oil include poly-α-olefin, polybutene and the like. More preferably, the hydrocarbon oil may comprise poly-α-olefin.

The base oil of the invention may further comprise other synthetic oils in addition to the synthetic hydrocarbon oil. Specific examples of such synthetic oils include synthetic ester type oils such as ester oils, diester oils and polyol ester oils; synthetic ether type oils such as alkyldiphenyl ether oils and polypropylene glycol; silicone oils; fluorinated oils and the like. In particular, the synthetic ester type oil and synthetic ether type oil are preferable.

In the base oil, a hydrocarbon oil, preferably a synthetic hydrocarbon oil, and more preferably poly-α-olefin may desirably be contained in an amount of 50 mass % or more, more desirably 80 mass % or more, and most desirably 100 mass %. The presence of a hydrocarbon oil in such an amount as mentioned above can produce excellent low-temperature properties.

The kinetic viscosity of the base oil at 40° C. may preferably be in the range of 5 to 100 $mm^2/s$, and more preferably 15 to 50 $mm^2/s$.

[Thickener]

Examples of the thickener used in the invention include soap thickeners such as Li-soap and Li-complex soap; urea thickeners such as diurea; inorganic thickeners such as organophilic clay and silica; organic thickeners such as PTFE, and the like.

The soap thickener is preferable, and in particular, lithium soap is more preferable. More specifically, lithium stearate or lithium 12-hydroxystearate is preferable, and the latter lithium 12-hydroxystearate is more preferable. The lithium soap is considered to be practical because of less disadvantages and lower cost.

The thickener may preferably be contained in an amount of 3 to 20 mass %, and more preferably 5 to 15 mass %, based on the total mass of the grease composition of the invention.

[Polymer Alloy]

The polymer alloy obtainable by chemical bonding of an olefin copolymer and a styrene-based copolymer is used in the invention.

The olefin copolymer for constituting the polymer alloy of the invention may include ethylene-propylene copolymer, ethylene-α-olefin copolymer and the like. The ethylene-propylene copolymer is preferred.

The olefin copolymer may preferably have a weight average molecular weight of 5,000 to 150,000, and more preferably 30,000 to 100,000. When the above-mentioned weight average molecular weight is less than 10,000, oil separation tends to easily occur. When the weight average molecular weight exceeds 150,000, the compatibility with the base oil will tend to decrease. The weight average molecular weight herein used is a value determined by gel permeation chromatography (GPC) in terms of polystyrene standard.

The styrene-based copolymer for constituting the polymer alloy of the invention is a copolymer of a styrene monomer and a constituent monomer other than a styrene monomer, e.g., alkene or alkadiene.

As the above-mentioned alkene, butene and propene are preferable. There is butadiene or isoprene as an example of the above-mentioned alkadiene. As the constituent monomer other than the styrene monomer, alkadiene is preferable, and isoprene is particularly preferable. Desirably, the styrene-based copolymer may be a block copolymer.

The styrene-based copolymer may preferably have a weight average molecular weight of 5,000 to 300,000, and more preferably 50,000 to 150,000.

The polymer alloy used in the invention may preferably have a weight average molecular weight of 10,000 to 450,000, and more preferably 80,000 to 250,000.

The content of the polymer alloy used in the invention may preferably be 0.1 to 10.0 mass %, more preferably 0.5 to 5.0 mass %, based on the total mass of the grease composition. The content of less than 0.1 mass % cannot sufficiently produce the effect. When the content exceeds 10.0 mass %, the effect will be saturated and the low-temperature operating properties may be impaired.

As the polymer alloy used in the invention, the commercially available products can be used. For example, a product under the trade name Lubrizol 7460 is available from Lubrizol Japan Limited.

[Additives]

The grease composition of the invention may further comprise other additives commonly used for grease compositions when necessary, in addition to the above-mentioned polymer alloy. For example, phenol- or amine-based antioxidants, metal corrosion inhibitors such as benzotriazole and the like can be used. The contents of such additives may generally be 0.01 to 10 mass %.

The worked penetration of the grease composition according to the invention, which may be adjusted according to the application of grease is preferably 200 to 350, and more preferably 235 to 325.

The grease composition of the invention can be produced by adding the above-mentioned polymer alloy which has been previously dissolved in a hydrocarbon oil-containing base oil to a base grease prepared by adding a thickener to a hydrocarbon oil-containing base oil, and kneading the above-mentioned mixture. The reaction conditions including the temperature and the period of time will appropriately be fixed by the ones skilled in the art. In the present invention, the polymer alloy of an olefin copolymer and a styrene-based copolymer, which has excellent compatibility with a hydrocarbon oil-containing base oil is used as the additive, so that it is possible to curtail the time required to dissolve the polymer alloy in the hydrocarbon oil-containing base oil. As a result, the grease composition can be produced speedily.

EXAMPLES

Sample Greases

A poly-α-olefin having a kinetic viscosity of 30.5 $mm^2/s$ at 40° C., a paraffin mineral oil having a kinetic viscosity of 40.3 $mm^2/s$ at 40° C., a synthetic ester oil having a kinetic viscosity of 30.5 $mm^2/s$ at 40° C., and a synthetic ether oil having a kinetic viscosity of 100 $mm^2/s$ at 40° C. were used for the base oil. The kinetic viscosity was determined in accordance with the method of JIS K 2220 23.

Lithium 12-hydroxystearate (Li-(12OH)St) was used as the thickener.

A polymer alloy of ethylene—propylene copolymer and styrene—isoprene block copolymer, commercially available from Lubrizol Japan Limited, under the trade name Lubrizol 7460, having a weight average molecular weight of 150,000 was used.

An olefin copolymer (Lubrizol 2019, available from Lubrizol Japan Limited), a styrene-based block copolymer A (Lubrizol 7306, available from Lubrizol Japan Limited) and a styrene-based block copolymer B (Infineum SV150, available from Infineum Japan Ltd.) were used as the additives for comparison.

A base grease containing a thickener and a base oil was prepared so that the content of the thickener might be 18.0%. Apart from the above-mentioned base grease, a polymer alloy or an additive for comparison was dissolved in the base oil. The base oil containing the polymer alloy or additive was added to the base grease and the resultant mixture was kneaded using a three-roll mill, so that a grease composition with a worked penetration of 280 was produced. The worked penetration was determined according to the method of JIS K2220 7.

The grease compositions thus produced were evaluated using the test methods as shown below. The degree of oil separation (%) determined by any of the test methods is a value obtained from calculation in accordance with the following formula:

$$(\text{Mass of separating oil}/\text{mass of grease composition})\times 100$$

The results are shown in Tables 1 to 3. In these tables, the figures in the columns of thickener, base oil and additive are expressed as percentage by mass.

<Test Methods>

Oil Separation (Evaluation of Oil Separation at High Temperatures)

The degree of oil separation was determined by the method as described in JIS K2220 11.

Oil Separation in Accordance with the IP Standard (Determination of Oil Separation by Pressure Filtration Method)

The oil separation was determined using the method as shown in the IP standard 121. The system for determination of oil separation by the IP standard is schematically illustrated in FIG. 1.

Each grease composition was placed into a given metal cup with a conical bottom of wire mesh. The mass of the grease was measured in advance. A weight (100 g) was loaded on the grease composition in the cup, and then the grease composition was allowed to stand at a predetermined temperature (40° C.) for a predetermined period of time (16 hours). After that, the separating oil collected in an oil cup was weighed.

Oil Separation by Crater Method (Evaluation of Syneresis)

A sample container shown below was filled with each of the grease compositions obtained in Examples and Comparative Examples. The following triangle-figured die plate was pressed into the grease to form a conical groove. The thus formed grease composition was allowed to stand for a predetermined period of time at a given temperature. Then, the content of oil separating from the grease composition and oozing out into the conical groove was measured.

Test Conditions

Sample container: A cylindrical glass container with an inner diameter of about 53 mm and a depth of about 56 mm.

Triangle-figured die plate: A metallic plate having three vertexes of a regular triangle with equal sides having a length of 50 mm and a thickness of 1 mm.

Temperature: 60° C.

Period of time: 168 hours

TABLE 1

| | | Examples | | | | Comparative Examples | | | | |
|---|---|---|---|---|---|---|---|---|---|---|
| | | 1 | 2 | 3 | 4 | 1 | 2 | 3 | 4 | 5 |
| Thickener | Li—(12OH)St | 9.0 | 9.0 | 9.0 | 9.0 | 9.0 | 9.0 | 9.0 | 9.0 | 10.0 |
| Base Oil | Poly-α-olefin | 90.0 | — | 70.0 | 70.0 | 90.0 | 90.0 | 90.0 | 90.0 | 90.0 |
| | Paraffin mineral oil | — | 90.0 | — | — | — | — | — | — | — |
| | Synthetic ester oil | — | — | 20.0 | — | — | — | — | — | — |
| | Synthetic ether oil | — | — | — | 20.0 | — | — | — | — | — |
| Additive | Polymer alloy of olefin copolymer and styrene-based block copolymer | 1.0 | 1.0 | 1.0 | 1.0 | — | — | — | — | — |
| | Olefin copolymer | — | — | — | — | 1.0 | — | — | 0.5 | — |
| | Styrene-based block copolymer A | — | — | — | — | — | 1.0 | — | 0.5 | — |
| | Styrene-based block copolymer B | — | — | — | — | — | — | 1.0 | — | — |
| Oil Separation | 100° C. × 24 h. | 1.0 | 0.5 | 1.1 | 1.0 | 2.4 | 3.1 | 2.8 | 1.5 | 4.8 |

TABLE 2

| | | Examples | | | | Comparative Examples | | | |
|---|---|---|---|---|---|---|---|---|---|
| | | 5 | 6 | 7 | 8 | 6 | 7 | 8 | 9 |
| Thickener | Li—(12OH)St | 9.0 | 9.0 | 9.0 | 9.0 | 8.0 | 9.0 | 7.0 | 8.0 |
| Base Oil | Poly-α-olefin | 89.0 | — | 69.0 | 69.0 | 90.0 | 89.0 | 91.0 | 90.0 |
| | Paraffin mineral oil | — | 89.0 | — | — | — | — | — | — |
| | Synthetic ester oil | — | — | 20.0 | — | — | — | — | — |
| | Synthetic ether oil | — | — | — | 20.0 | — | — | — | — |
| Additive | Polymer alloy of olefin copolymer and styrene-based block copolymer | 2.0 | 2.0 | 2.0 | 2.0 | — | — | — | — |
| | Olefin copolymer | — | — | — | — | 2.0 | — | — | 1.0 |
| | Styrene-based block copolymer A | — | — | — | — | — | 2.0 | — | 1.0 |
| | Styrene-based block copolymer B | — | — | — | — | — | — | 2.0 | — |
| Oil Separation | 100° C. × 24 h. | 0.2 | 0.1 | 0.2 | 0.2 | 2.1 | 0.6 | 1.4 | 0.6 |

TABLE 3

| | | Examples | | | | Comparative Examples | | | |
|---|---|---|---|---|---|---|---|---|---|
| | | 9 | 10 | 11 | 12 | 10 | 11 | 12 | 13 |
| Thickener | Li—(12OH)St | 8.0 | 8.0 | 8.0 | 8.0 | 8.0 | 8.0 | 6.0 | 7.2 |
| Base Oil | Poly-α-olefin | 89.0 | — | 69.0 | 69.0 | 89.0 | 89.0 | 91.0 | 89.8 |
| | Paraffin mineral oil | — | 89.0 | — | — | — | — | — | — |
| | Synthetic ester oil | — | — | 20.0 | — | — | — | — | — |
| | Synthetic ether oil | — | — | — | 20.0 | — | — | — | — |
| Additive | Polymer alloy of olefin copolymer and styrene-based block copolymer | 3.0 | 3.0 | 3.0 | 3.0 | — | — | — | — |
| | Olefin copolymer | — | — | — | — | 3.0 | — | — | 1.5 |
| | Styrene-based block copolymer A | — | — | — | — | — | 3.0 | — | 1.5 |
| | Styrene-based block copolymer B | — | — | — | — | — | — | 3.0 | — |

TABLE 3-continued

| | | Examples | | | | Comparative Examples | | | |
|---|---|---|---|---|---|---|---|---|---|
| | | 9 | 10 | 11 | 12 | 10 | 11 | 12 | 13 |
| Oil Separation | 100° C. × 24 h. | 0 | 0 | 0 | 0 | 1.9 | 0.4 | 0.3 | 0.5 |
| IP Oil Separation | 40° C. × 16 h. | 0.16 | 0.12 | 0.18 | 0.15 | 1.98 | 0.62 | 0.49 | 0.70 |
| Crater Oil Separation | 60° C. × 168 h. | 0.11 | 0.08 | 0.12 | 0.11 | 0.89 | 0.27 | 0.14 | 0.31 |

What is claimed is:

1. A grease composition comprising:

a thickener, a base oil consisting of a hydrocarbon oil, and a polymer alloy comprising an ethylene-propylene copolymer and a styrene-isoprene copolymer, wherein the thickener is lithium 12-hydroxystearate and is contained in an amount of 3 to 20 mass % based on the total mass of the composition, and wherein the polymer alloy has a weight average molecular weight of 10,000 to 450,000 and is contained in an amount of 0.1 to 10.0 mass % based on the total mass of the composition.

2. The grease composition of claim 1, wherein the polymer alloy comprises an ethylene-propylene copolymer and a block copolymer of styrene and isoprene.

3. A structure part enclosing the grease composition of claim 1.

4. A method for producing a grease composition, comprising the step of kneading a base grease comprising lithium 12-hydroxystearate as a thickener and a base oil together with a base oil comprising a polymer alloy of an ethylene-propylene copolymer and a styrene-isoprene copolymer, wherein the base oils consist of hydrocarbon oil, wherein the thickener is contained in an amount of 3 to 20 mass % based on the total mass of the composition, and wherein the polymer alloy has a weight average molecular weight of 10,000 to 450,000 and is contained in an amount of 0.1 to 10.0 mass % based on the total mass of the composition.

5. The method of claim 4, wherein the polymer alloy comprises an ethylene-propylene copolymer and a block copolymer of styrene and isoprene.

6. The grease composition of claim 1, wherein the base oil has a kinetic viscosity at 40° C. of 5 to 100 $mm^2/s$.

7. The method of claim 4, wherein the base oil has a kinetic viscosity at 40° C. of 5 to 100 $mm^2/s$.

* * * * *